US005527188A

United States Patent [19]

Ohtaka et al.

[11] Patent Number: 5,527,188

[45] Date of Patent: Jun. 18, 1996

[54] WATERPROOF CONNECTOR

[75] Inventors: Kazuto Ohtaka; Hitoshi Sakai, both of Shizuoka-ken, Japan

[73] Assignee: Yazaki Corporation, Tokyo, Japan

[21] Appl. No.: 409,686

[22] Filed: Mar. 23, 1995

[30] Foreign Application Priority Data

Mar. 24, 1994 [JP] Japan ..... 6-054149

[51] Int. Cl.[6] ..... H01R 13/40; H01R 13/44

[52] U.S. Cl. ..... 439/587; 439/275

[58] Field of Search ..... 439/274, 275, 439/587

[56] References Cited

U.S. PATENT DOCUMENTS

| | | | |
|---|---|---|---|
| 3,328,746 | 6/1967 | Schumacher | 439/587 |
| 4,150,866 | 4/1979 | Snyder, Jr. et al. | 439/275 |
| 4,643,506 | 2/1987 | Kobler | 439/587 |
| 4,886,471 | 12/1989 | Fleshman, Jr. | 439/587 |
| 5,295,865 | 3/1994 | Endo et al. | 439/587 |

*Primary Examiner*—Stephen P. Garbe

*Attorney, Agent, or Firm*—Wigman, Cohen, Leitner & Myers

[57] ABSTRACT

A waterproof connector includes :a connector housing (11) formed with a plurality of oval terminal insertion holes (12) arranged at close intervals in a minor axis direction of the oval terminal insertion holes; and a waterproof plug (30) for sealing a gap between the wire (4) inserted into the terminal insertion hole (12) and an inner wall of the terminal insertion hole, having an inner cylindrical portion (32) and an outer cylindrical portion (33). The inner cylindrical portion (32) air-tightly is fitted to an outer circumference of the wire (4). The outer cylindrical portion (33) brought into tight contact with the inner wall of the terminal insertion hole (12) when the waterproof plug is pressure inserted into the terminal insertion hole. The outer cylindrical portion (33) is formed Integral with the inner cylindrical portion (32) so as to provide a hollow cylindrical portion (35) between the inner and outer cylindrical portions. The hollow cylindrical portion (35) absorbs deformation of the outer cylindrical portion pressure inserted into the terminal insertion hole.

6 Claims, 4 Drawing Sheets

WATERPROOF CONNECTOR

BACKGROUND OF THE INVENTION

1. Technical Field

The present invention relates to a waterproof connector having a waterproof plug. The waterproof plug is used to seal a gap between a wire inserted into a terminal insertion hole of a connector housing and an inner wall surface of the terminal insertion hole formed in the connector housing.

2. Description of the Related Art

In an ordinary waterproof connector, when a terminal is inserted into a terminal insertion hole of a connector housing, a rubber waterproof plug is fitted to an outer circumferential surface of a wire extending from a terminal, and then the waterproof plug and the terminal are both pressure inserted into the terminal insertion hole together, so that a gap between the wire and the terminal insertion hole can be sealed. In the prior art waterproof plug, the rubber plug is formed into a cylindrical (circular in cross section) shape and formed with a central hole through which the wire can be passed. In addition, the rubber plug is formed with a front clamped portion clamped by the terminal and with a plurality of projections on the inner and outer circumferential surfaces of the cylindrical rubber for increasing the tightness against the wire and the terminal insertion hole, respectively. Further, the terminal insertion hole of tile connector housing is formed into a circular shape in the same way as the shape of the waterproof plug.

In the above-mentioned prior art waterproof plug, however, since the circular waterproof plug is inserted into the circular terminal insertion hole of the connector housing, when a plurality of terminals are arranged in a horizontal direction, a plurality of the circular terminal insertion holes are arranged also in the horizontal direction, so that there exists a problem in that the dimension of the connector housing increases in the horizontal (width) direction thereof and thereby the connector size becomes large.

To overcome this problem, Japanese Published Unexamined Utility Model Application 64-19271 discloses a connector housing formed with a plurality of oval terminal insertion holes arranged in the horizontal (width) direction thereof and a waterproof plug formed also into an oval shape. In more detail, in order to reduce the horizontal (width) dimension of the connector housing, each wire insertion hole is formed into an oval shape (including an ellipse, an elongated circle, a chamfered square, etc.) elongated in the vertical (height) direction, and a plurality of the oval wire Insertion holes are arranged in the horizontal (minor axis) direction. Further, the waterproof plug is also formed into roughly an oval shape according to the oval wire insertion holes.

In this prior art waterproof plug, however, whenever the oval waterproof plug is clamped to the terminal, the directions of both the terminal and the oval waterproof plug must be matched each other, and in addition the oval waterproof plug (to which tile terminal has been clamped) must be inserted into the oval terminal insertion hole after having been located in the correct direction relative to each other. In particular, when the directions of the oval waterproof plug and the terminal mismatch each other, the waterproof performance inevitably deteriorates. In addition, in order to mold the oval rubber waterproof plug, there exists another problem in that the molding dies are difficult to be manufactured and managed.

On the other hand, Japanese Published Unexamined Utility Model Application 61-23275 discloses a connector formed with a plurality of oval terminal insertion holes and a waterproof plug formed into a circular shape. In more detail, in order to reduce the horizontal (width) dimension of the connector housing, each wire insertion hole is formed into an oval shape elongated in the height direction, and a plurality of the oval wire insertion holes are arranged in both the horizontal (minor axis) and vertical (major axis) directions. In this prior art waterproof plug, therefore the circular waterproof plug is to be pressure inserted into the oval wire insertion holes of the connector housing to seal a gap therebetween.

In this prior art waterproof plug, since the waterproof plug is formed Into a circular shape, it is possible to overcome the problem involved in the oval waterproof plug. However, since the circular waterproof plug must be inserted into the oval wire insertion hole under pressurized and deformed condition, there exists such a problem that the wire insertion hole is easily deformed and thereby the gap between the wire and the wire insertion hole cannot be sealed perfectly, with the result that it is difficult to obtain a stable waterproof performance. In addition, since the waterproof plug must be deformed largely, a large force is inevitably required to deform the circular waterproof plug and further to insert the deformed waterproof plug into the oval wire insertion hole.

SUMMARY OF THE INVENTION

With these problems in mind, therefore, it is the object of the present invention to provide a waterproof connector having a waterproof plug, which is formed into circular shape for solving the problems related to the direction matching and tile molding die manufacturing, but stable in the waterproof performance and easy to be inserted into the wire insertion hole of the connector housing.

Further, the other object of the present invention is to provide a waterproof connector of small size, which can use the waterproof plug according to the present invention.

To achieve the above-mentioned object, the present invention provides a waterproof connector including: a connector housing (11) formed with a plurality of oval terminal insertion holes (12) arranged at close intervals in a minor axis direction of the oval terminal insertion holes; and a waterproof plug (30) for sealing a gap between the wire (4) inserted into the terminal insertion hole (12) and an inner wall of the terminal insertion hole, having an inner cylindrical portion (32) and an outer cylindrical portion (33). The inner cylindrical portion (32) air-tightly is fitted to an outer circumference of the wire (4). The outer cylindrical portion (33) brought into tight contact with the inner wall of the terminal insertion hole (12) when the waterproof plug is pressure inserted into the terminal insertion hole. The outer cylindrical portion (33) is formed integral with tile inner cylindrical portion (32) so as to provide a hollow cylindrical portion (35) between the inner and outer cylindrical portions. The hollow cylindrical portion (35) absorbs deformation of the outer cylindrical portion pressure inserted into the terminal insertion hole.

Further, an axial length of said outer cylindrical portion (33) is roughly a half of that of the inner cylindrical portion (32). It is preferable that a dimensional difference (2H1) between an outer diameter of the outer cylindrical portion (33) of the waterproof plug and a minor axis length of the oval terminal insertion hole (12) is roughly equal to or less than a dimensional difference (2H2) between the outer diameter of the outer cylindrical portion (33) of the waterproof plug and a major axis length of the oval terminal insertion hole (12). Further, it is preferable that the waterproof plug is further formed with at least one inner projection (32*a*) in an inner circumferential surface of the inner cylindrical portion (32) for increasing air-tightness against the wire (4), and at least one outer projection (33*a*) in an outer circumferential surface of the outer cylindrical portion (33) for increasing air-tightness against the terminal insertion hole (12).

In the waterproof connector according to the present invention, since the hollow cylindrical portion is formed under the outer cylindrical portion, when the waterproof plug is inserted into the oval terminal insertion hole, tile outer cylindrical portion can be easily deformed or crushed. Accordingly, it is possible to insert the circular waterproof plug into an oval terminal insertion hole easily and further to bring the outer cylindrical portion thereof into tight contact with the oval terminal insertion hole uniformly. Further, since the deformation of the outer cylindrical portion can be absorbed by the hollow cylindrical portion, the sealing performance between the wire and the inner cylindrical portion is not subjected to the influence of the deformation of the outer cylindrical portion inserted into the oval terminal insertion hole.

Owing to the circular waterproof plug, it is possible to solve various problems involved when the plug is clamped with the terminal (directivity) or when the molding die is manufactured (workability). On the other hand, since the terminal insertion holes of oval cross-sectional shape are arranged at close intervals in the horizontal direction, it is possible to reduce the size of the connector.

Further, in the waterproof connector according to the present invention, the terminal insertion holes are formed into oval shape, since the circular waterproof plug can be inserted into the oval terminal insertion holes, it is possible to maintain a stable waterproof performance and an excellent terminal insertion productivity, while reducing the size of the connector housing.

DETAILED DESCRIPTION OF THE EMBODIMENTS

Figure 1:
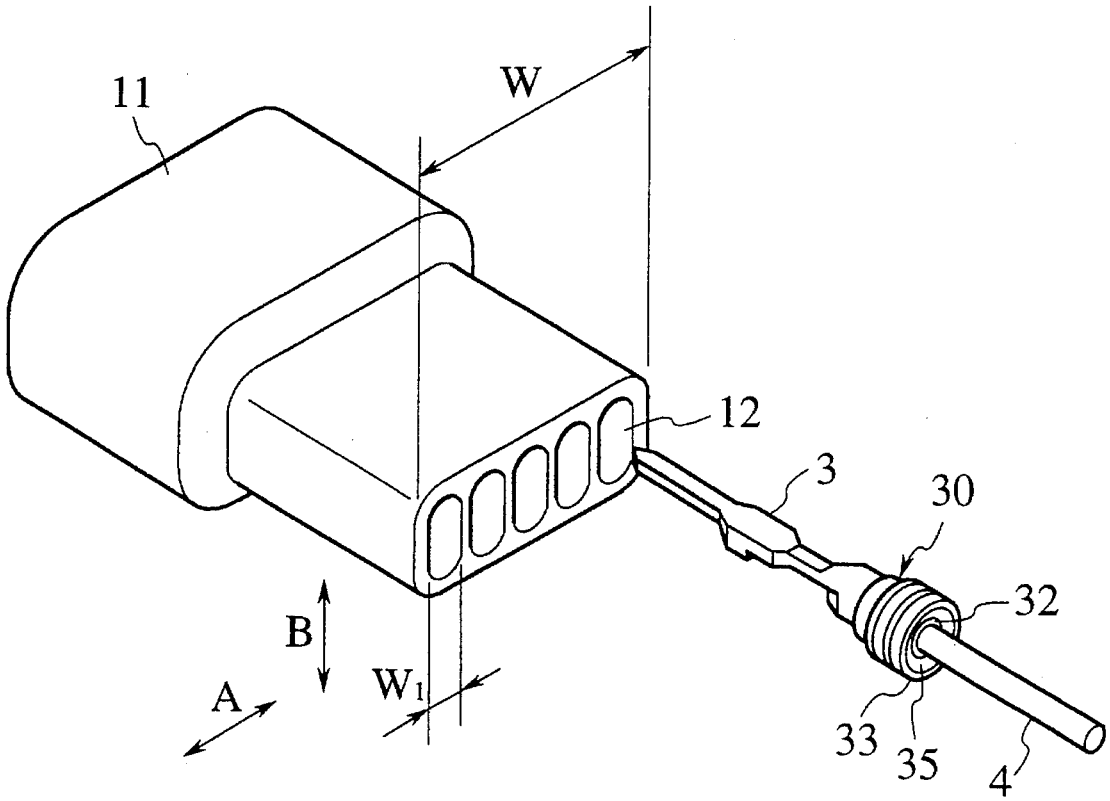
FIG. 1 is a perspective view showing an embodiment of the waterproof connector according to the present invention.

An embodiment of the waterproof connector according to the present invention will be described hereinbelow with reference to the attached drawings. In FIG. 1, a connector housing 11 is formed with a plurality of terminal insertion holes 12. The terminal insertion holes 12 are roughly oval in the cross-sectional shape, respectively and arranged at close intervals in the horizontal direction. The minor axis of each terminal insertion hole 12 extends in the horizontal direction (the arrow A in FIG. 1) and the major axis thereof extends in tile vertical direction (the arrow B in FIG. 1). Further, each hole width is W1 and the total hole width is W both in the horizontal direction. A wire 4 is clamped by a rear end of a terminal 3. A waterproof plug 30 is fitted to the outer circumference of the wire 4, and a front end of the waterproof plug 30 is clamped by the rear end of the terminal 3. The terminal 3 to which the wire 4 and the waterproof plug 30 are clamped is inserted into each of tile oval terminal insertion holes 12 of the connector housing 11.

Figure 2A:
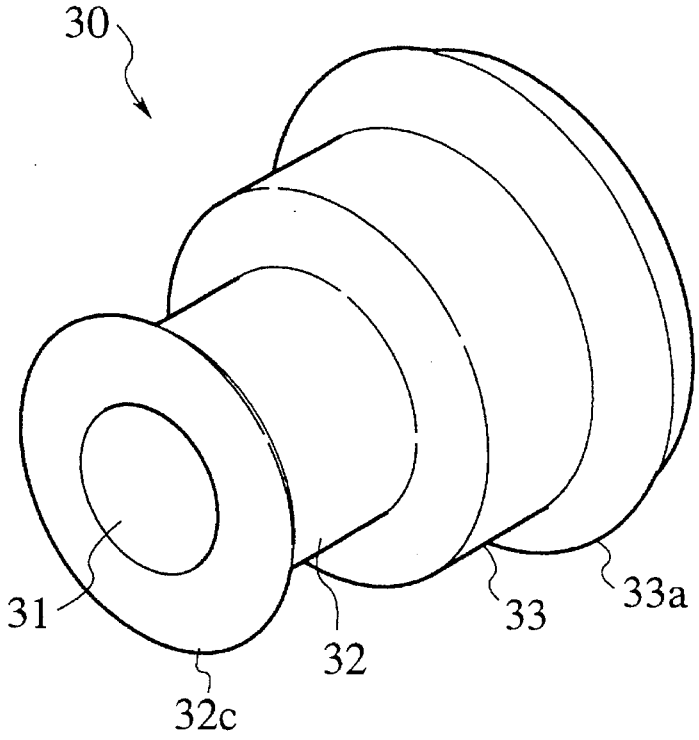
FIG. 2A is a perspective view showing an embodiment of the waterproof plug according to the present invention.
Figure 2B:
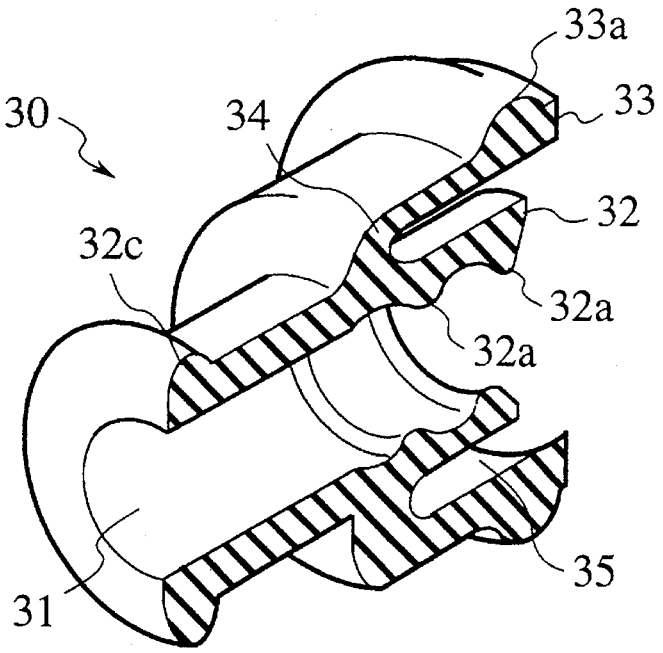
FIG. 2B is a perspective longitudinal cross-section view showing the same waterproof plug according to the present invention.

The waterproof plug 30 will be described in further detail hereinbelow. As shown in FIGS. 2A and 2B, the waterproof plug 30 is formed of a rubber as a molded part. The waterproof plug 30 is formed with an inner cylindrical portion 32 for forming a wire insertion hole 31 and an outer cylindrical portion 33 formed integral with the inner cylindrical portion 32. The front end 34 of tile outer cylindrical portion 33 is connected to the inner cylindrical portion 32 at an axially intermediate portion thereof. That is, the axial length of the outer cylindrical portion 33 is roughly half of that of the inner cylindrical portion 32. Here, it should be noted that a hollow cylindrical portion 35 is formed between the inner cylindrical portion 32 and the outer cylindrical portion 33 so as to separate the outer cylindrical portion 33 from the inner cylindrical portion 32. The size of the hollow cylindrical portion 35 is determined to such an extent that the deformation of the outer cylindrical portion 33 can be sufficiently absorbed when tile waterproof plug 30 is pressure inserted into the terminal insertion hole 12 of the connector housing 11.

Figure 4:
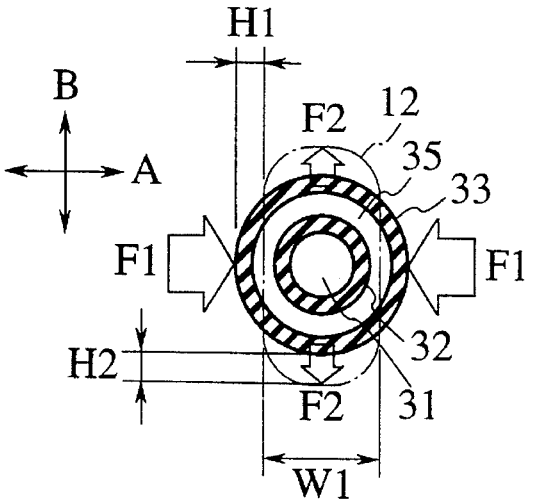
FIG. 4 is a front view for assistance in explaining forces generated when the waterproof plug according to the present invention is inserted into the wire insertion hole.

In more detail, as shown in FIG. 4, the outer diameter of the outer cylindrical portion 33 is determined according to the size of the terminal insertion hole 12, in such a way that the dimensional difference 2H1 in the minor axis direction A between the outer diameter of the outer cylindrical portion 33 and the minor axis length of the oval terminal insertion hole 12 is roughly equal to or smaller than the dimensional difference 2H2 in the major axis direction B between the outer diameter of the outer cylindrical portion 33 and the major axis length of the oval terminal insertion hole 12. Therefore, when the outer cylindrical portion 33 is pressure inserted into the terminal insertion hole 12, the outer circumferential surface of the outer cylindrical portion 33 can be brought into pressure contact roughly uniformly with the inner wall of the terminal insertion hole 12.

Figure 6:
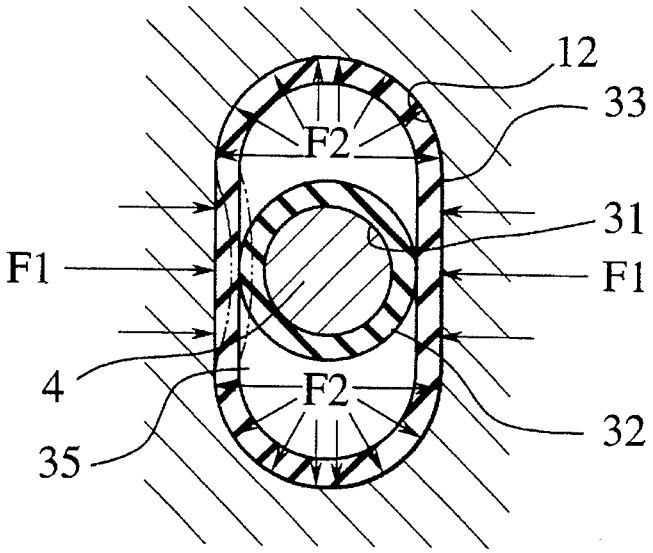
FIG. 6 is a front view for assistance In explaining forces generated when tile outer cylindrical portion of the waterproof plug according to the present invention is inserted into the wire insertion hole.

Further as shown in FIG. 6, the dimension of the terminal insertion hole 12, the outer cylindrical portion 33 and the inner cylindrical portion 32 are determined so that the sum of a diameter of the wire 4, two times the thickness of the inner cylindrical portion 32 and two times the thickness of the outer cylindrical portion 33 is roughly equal to the minor axis length of tile oval terminal insertion hole 12. Therefore, when the wire 4 is inserted into the waterproof plug 30 and tile waterproof plug 30 is inserted into the terminal insertion hole 12, the outer circumferential surface of the inner cylindrical portion 32 comes into contact with the inner circumferential surface of the outer cylindrical portion 33. Accordingly if the portion of the outer cylindrical portion 33 near to the minor axis of the oval terminal insertion hole 12 bulges out inwardly, as shown with a phantom line in FIG. 6, the bulging portion is supported by the inner cylindrical portion 32. Consequently the outer cylindrical potion is prevented from bulging inwardly.

Further, as shown in FIG. 2B, in order to increase the tightness against the wire 4, the inner cylindrical portion 32 of the waterproof plug 30 is formed with two inner projections 32*a* and 32*a* triangular in cross section spaced at an interval. On the other hand, in order to increase the tightness against the inner wall of the terminal insertion hole 12, the outer cylindrical portion 33 of the waterproof plug 30 is formed with an outer projection 33*a* also triangular in cross section at a rear end outer circumferential surface thereof. Further, the front end of the inner cylindrical portion 32 extends from the front end of the outer cylindrical portion 33. Another outer projection 32*c* is formed at the front end of the inner cylindrical portion 32 to prevent the waterproof plug 30 from being removed from the terminal 3 after the waterproof plug 30 has been clamped with the terminal 3.

Figure 3:
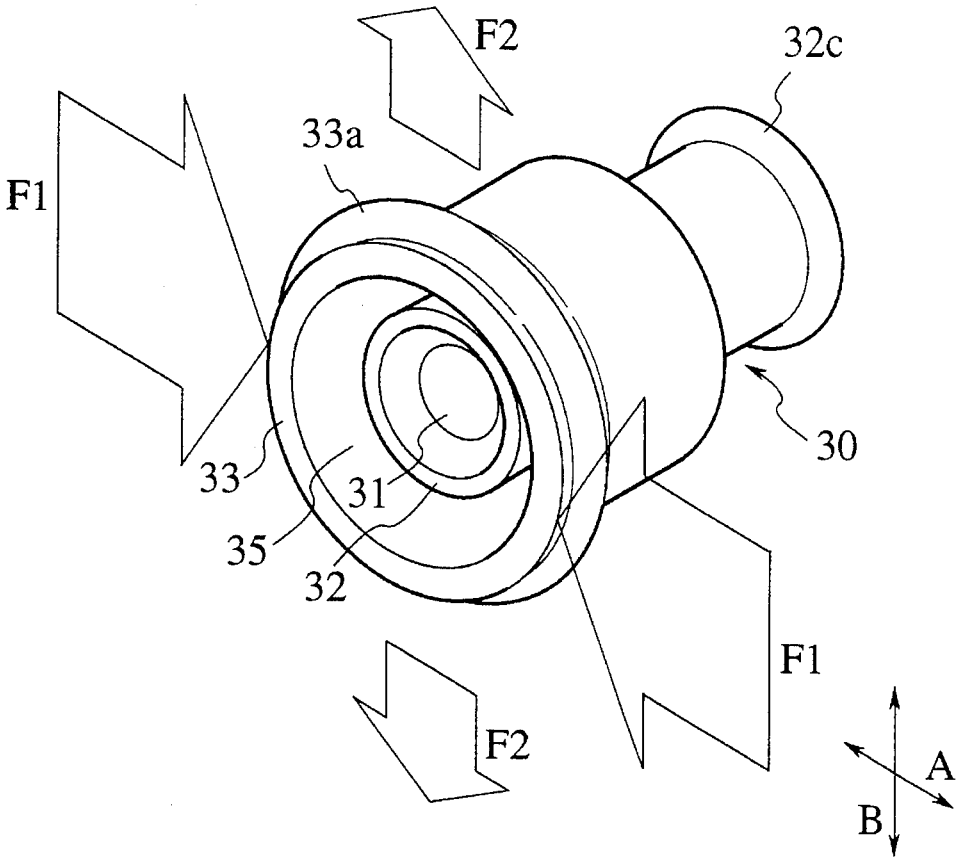
FIG. 3 is a perspective view for assistance in explaining forces generated when the waterproof plug according to the present invention is inserted into the wire insertion hole.
Figure 5:
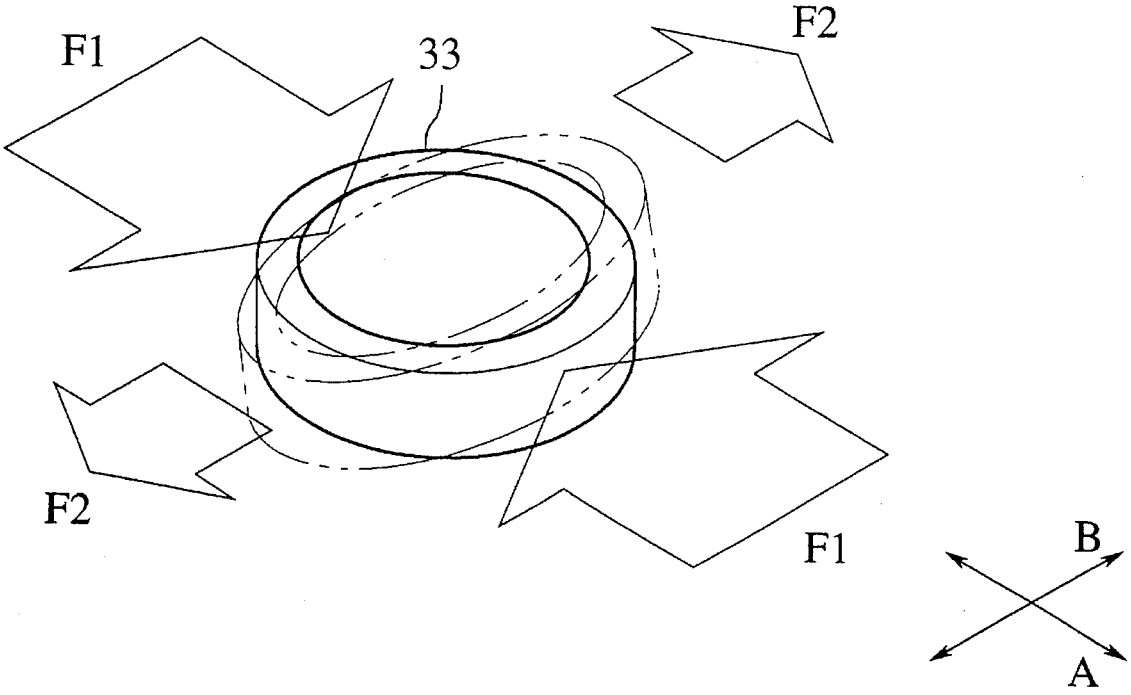
FIG. 5 is a perspective view for assistance in explaining forces generated when the outer cylindrical portion of the waterproof plug according to the present invention is inserted into the wire insertion hole.

In assembly of the waterproof plug 30 with the terminal and the connector housing 11, as depicted in FIG. 1, the wire 4 is clamped with the terminal 3; the waterproof plug 30 is fitted to the outer circumferential surface of the wire 4; and tile front end of the waterproof plug 30 is clamped with the rear end of tile terminal 3. After that, as shown in FIGS. 3 and 4, the outer cylindrical portion 33 of the waterproof plug 30 is pressure inserted into the terminal insertion hole 12 by crushing the waterproof plug 30 under application of an external force F1 from both the horizontal sides (in the minor axis direction A of the terminal insertion hole 12). In this case, the outer cylindrical portion 33 is crushed to such a dimension as to correspond to the minor axis width W1 of the terminal insertion hole 12 in the horizontal (minor axis) direction A. Under these conditions, as shown In FIGS. 5 and 6, since the waterproof plug 30 is expanded in the vertical (major axis) direction B by a force F2, the expanded portion of the waterproof plug 30 can be brought into pressure contact with the inner wall of the terminal insertion hole 12 under a pressure of F2 in the major axis direction B. Further, when the compressive force applied to the outer cylindrical portion 33 in the minor axis direction A is released, the outer cylindrical portion 33 can be brought into pressure contact with the inner wall of the terminal insertion hole 12 also in the horizontal (minor axis) direction A. Accordingly, the outer circumferential surface of the outer cylindrical portion 33 of the waterproof plug 30 can be brought uniformly into tight contact with the inner wall of the oval terminal insertion hole 12, so that a gap between the outer cylindrical portion 33 and the terminal insertion hole 12 can be securely sealed. In the waterproof plug 30 according to the present invention, since the hollow cylindrical portion 35 for absorbing the deformation of the outer cylindrical portion 33 is formed inside the outer cylindrical portion 33, the outer cylindrical portion 33 can be deformed easily, so that it is possible to pressure insert the waterproof plug 30 into the terminal insertion hole 12 of the connector housing 11 by a small force.

Further, when the outer cylindrical portion 33 is deformed and inserted into the terminal insertion hole 12, since the deformation of the outer cylindrical portion 33 can be absorbed by the hollow cylindrical portion 35, the inner cylindrical portion 32 is not subjected to the influence of the deformation of the outer cylindrical portion 33, so that it is possible to maintain the sealing performance between the inner cylindrical portion 32 and the wire 4.

Further, since the waterproof plug 30 is circular in cross-sectional shape, when the waterproof plug 30 is clamped with the terminal 3, it is unnecessary to consider the matching direction of the waterproof plug 30 with respect to the terminal 4. Further, the molding die for the circular plug can be manufactured and managed easily, thus reducing the manufacturing cost thereof. On the other hand, in the waterproof connector, since the oval terminal insertion holes 12 are arranged at close intervals in the horizontal direction, it is possible to reduce the width dimension W of the connector housing 11.

Further, as the material of the waterproof plug 30, a soft resin can be used, instead of rubber.

As described above, in the waterproof connector according to the present invention, since the water plug is formed with an outer cylindrical portion and an inner cylindrical portion and thereby since a hollow cylindrical portion is formed between the two outer and inner cylindrical portions so as to absorb the deformation of the outer cylindrical portion, it is possible to easily deform the outer cylindrical portion of the plug and further insert the deformed plug into the terminal insertion hole of the connector housing by a small force. Further, since being formed independently from the outer cylindrical portion, the inner cylindrical portion is not subjected to the influence of the deformation of the outer cylindrical portion, so that it is possible to obtain a stable waterproof performance between tile wire and the plug. Owing to the circular waterproof plug, it is possible to solve various problems involved when the plug is clamped with the terminal (directivity) or when the molding die is manufactured (workability). On the other hand, since the terminal insertion holes of oval cross-sectional shape are arranged at close intervals in the horizontal direction, it is possible to maintain a stable waterproof performance and an excellent terminal insertion productivity, while reducing the size of the connector housing.

What is claimed is:

1. A waterproof connector comprising:

a connector housing (11) formed with a plurality of oval terminal insertion holes (12) arranged at close intervals in a minor axis direction of the oval terminal insertion holes; and a waterproof plug (30) for sealing a gap between a wire (4) inserted into the terminal insertion hole (12) and an inner wall of the terminal insertion hole, including:

an inner cylindrical portion (32) air-tightly fitted to an outer circumference of the wire (4); and an outer cylindrical portion (33) brought into tight contact with the inner wall of the terminal insertion hole (12) when the waterproof plug is pressure inserted into the terminal insertion hole, said outer cylindrical portion (33) being formed integral with said inner cylindrical portion (32) so as to provide a hollow cylindrical portion (35) between said inner and outer cylindrical portions, the hollow cylindrical portion (35) absorbing deformation of the outer cylindrical portion pressure inserted Into the terminal insertion hole.

2. The waterproof connector of claim 1, wherein an axial length of said outer cylindrical portion (33) is roughly a half of that of said inner cylindrical portion (32).

3. The waterproof connector of claim 1, wherein a dimensional difference (2H1) between an outer diameter of said outer cylindrical portion (33) of the waterproof plug and a minor axis length of the oval terminal insertion hole (12) is roughly equal to or less than a dimensional difference (2H2) between the outer diameter of said outer cylindrical portion (33) of the waterproof plug and a major axis length of the oval terminal insertion hole (12).

4. The waterproof connector of claim 1, further comprising at least one inner projection (32*a*) in an inner circumferential surface of said inner cylindrical portion (32) for increasing air-tightness against the wire (4).

5. The waterproof connector of claim 1, further comprising at least one outer projection (33*a*) in an outer circumferential surface of said outer cylindrical portion (33) for increasing air-tightness against the terminal insertion hole (12).

6. The waterproof connector of claim 1, wherein the sum of a diameter of the wire (4), two times the thickness of the inner cylindrical portion (32) and two times the thickness of the outer cylindrical portion (33) is roughly equal to the minor axis length of the oval terminal insertion hole (12).

* * * * *

UNITED STATES PATENT AND TRADEMARK OFFICE

CERTIFICATE OF CORRECTION

PATENT NO. : 5,527,188

DATED : June 18, 1996

INVENTOR(S) : Kazuto Ohtaka; Hitoshi Sakai

It is certified that error appears in the above-indentified patent and that said Letters Patent is hereby corrected as shown below:

On the title page, insert item

[56] FOREIGN PATENT DOCUMENTS

UM 61-23275 2/12/86 Japan
UM 64-19272 1/31/89 Japan

Signed and Sealed this

Ninth Day of December, 1997

*Attest:*

*Attesting Officer*

BRUCE LEHMAN

*Commissioner of Patents and Trademarks*